US005144962A

United States Patent [19]

Counts et al.

[11] Patent Number: 5,144,962

[45] Date of Patent: Sep. 8, 1992

[54] FLAVOR-DELIVERY ARTICLE

[75] Inventors: Mary E. Counts; Mohammad R. Hajaligol, both of Richmond; Constance H. Morgan; Ulysses Smith, both of Midlothian; Francis M. Sprinkel, Glen Allen; Francis V. Utsch, Midlothian, all of Va.

[73] Assignee: Philip Morris Incorporated, New York, N.Y.

[21] Appl. No.: 444,818

[22] Filed: Dec. 1, 1989

[51] Int. Cl.[5] ..... A24D 1/00

[52] U.S. Cl. ..... 131/194; 131/335; 128/200.14; 128/202.21; 128/203.26; 128/203.27; 128/204.13

[58] Field of Search ..... 131/270, 194, 195, 329, 131/330, 335; 128/200.14, 202.21, 203.26, 203.27, 204.13

[56] References Cited

U.S. PATENT DOCUMENTS

| | | | |
|---|---|---|---|
| 4,735,217 | 4/1988 | Gerth et al. | 131/273 |
| 4,922,901 | 5/1990 | Brooks et al. . | |
| 4,945,931 | 8/1990 | Gori . | |
| 4,947,874 | 8/1990 | Brooks et al. . | |
| 4,947,875 | 8/1990 | Brooks et al. . | |

FOREIGN PATENT DOCUMENTS

WO90/03224 4/1990 PCT Int'l Appl. .

*Primary Examiner*—V. Millin

*Attorney, Agent, or Firm*—Jeffrey H. Ingerman

[57] ABSTRACT

Methods and apparatus for releasing flavor components from a flavor-generating medium using an electric heating element are provided. A non-combustion flavor-generating article uses electrical energy to power a heating element which heats tobacco or other flavorants. The flavor-generating medium is formed into a packed bed. Energy delivered to the heating element is regulated to maintain the flavor-generating medium at a relatively constant operating temperature to ensure a relatively constant release of flavor.

146 Claims, 9 Drawing Sheets

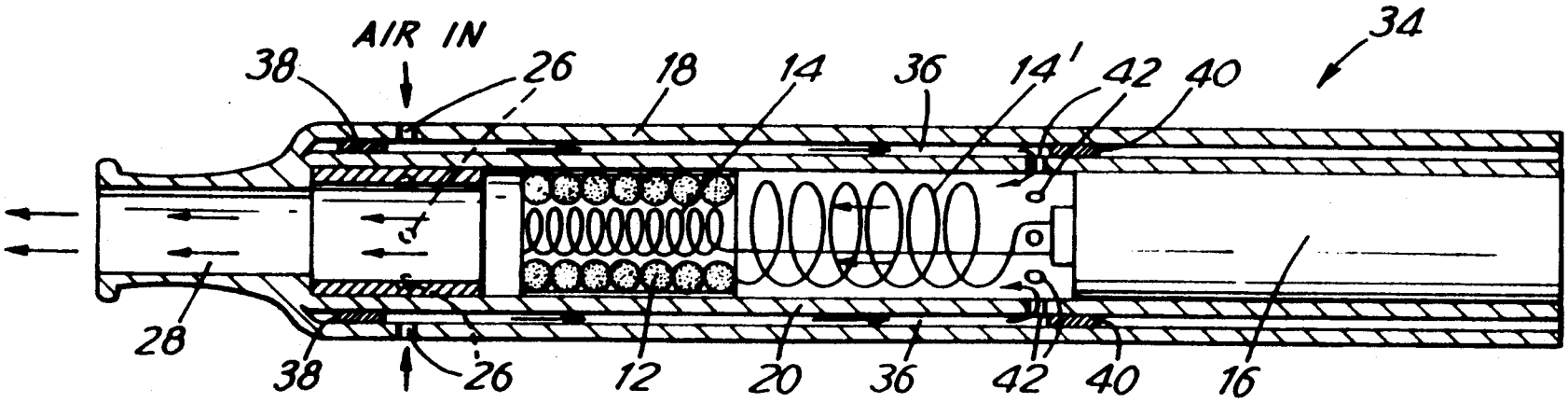
FIG. 3
FIG. 6
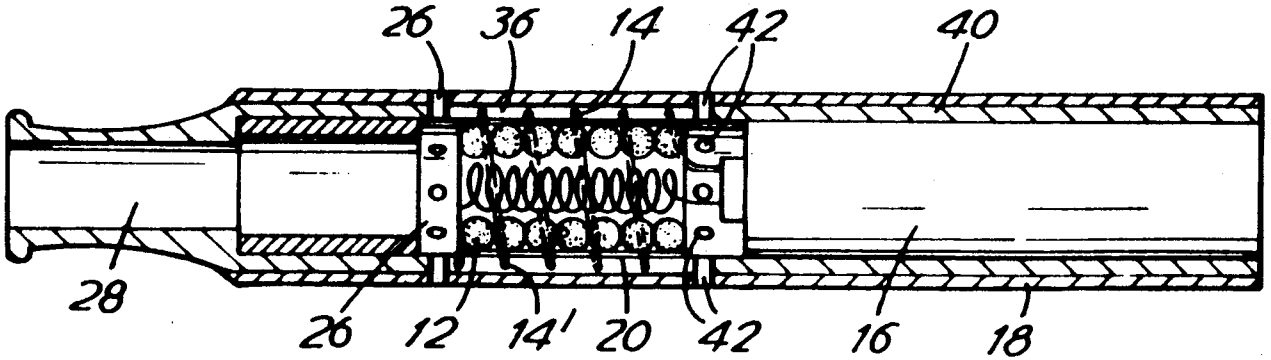

FLAVOR-DELIVERY ARTICLE

BACKGROUND OF THE INVENTION

This invention relates to electrically-heated flavor-delivery articles, and to methods and apparatus for electrically heating a flavor source in order to derive flavor therefrom.

Smoking articles utilizing electrical power for heating and thereby releasing flavor from tobacco and other compounds may have certain advantages over conventional smoking articles. For example, electrically-heated smoking articles produce the taste and sensation of smoking without burning of tobacco. Also, electrically-heated articles do not produce a visible aerosol between puffs. However, there have been various technical problems with electrically-heated articles.

It is desirable to maintain the smoking article at a substantially consistent temperature during operation to produce a relatively consistent release of flavor from puff to puff. The smoking article must reach operating temperature quickly, it must not overheat, and it must remain at the operational temperature long enough to generate/release designed flavors, vapors, and aerosols (hereinafter "flavor components"). The article should also be efficient in terms of its power consumption.

SUMMARY OF THE INVENTION

In view of the foregoing, it is an object of this invention to provide an electrically-heated device for generating flavor components.

It is a more particular object of this invention to provide an electrically-heated article which reduces or eliminates certain byproducts of burning.

It is another object of this invention to provide an electrically-heated article in which flavor components are consistently released from puff to puff.

It is yet another object of this invention to provide an electrically-heated article which allows controlled flavor component delivery with a minimal amount of input energy.

It is still another object of this invention to provide an electrically-heated article having a passive system for predictably controlling the temperature of the heating element.

It is still another object of this invention to provide an electrically-heated article having an active system for predictably controlling the temperature of the heating element.

These and other objects of the invention are accomplished by providing electrically powered devices having a flavor-generating medium capable of generating/releasing flavor components when heated, a heating element, a power source, and a control system for regulating the temperature of the flavor-generating medium or the amount of power applied to the heating element.

The article of this invention releases a controlled amount of flavor components. A heating element raises the temperature of a flavor-generating medium to a predetermined temperature, which is below the temperature at which burning begins. For example, a non-burning article is formed by surrounding a positive temperature coefficient thermistor with the flavor-generating medium to be heated, capturing the material and heating element in a tube (which typically may be foil-lined), attaching a filter, and providing an outer wrapper for the article. The flavor-generating medium is heated by applying electrical energy to the thermistor. The thermistor draws electrical current, which raises the temperature of the thermistor to some predetermined "transition" temperature. The transition temperature is a known value, determined by the composition of the thermistor, at which the device's temperature stabilizes.

Alternatively, a control system applies a predetermined, timed voltage cycle to the heating element, or temperature cycle to the flavor-generating medium, pulsing the temperature of the medium to the preferred temperature to produce flavor components. This multistage operation reduces power consumption, because the flavor generator is at elevated temperatures for only short periods of time.

In addition to providing flavor components for enjoyment, articles made in accordance with this invention provide a means for regulating the delivery of the flavor components produced by the article. The amount of flavor released from the flavor-generating medium varies according to the temperature to which the flavor-generating medium is heated. By selecting heating elements, power supplies, and control systems with the proper operating characteristics, articles of different deliveries can be produced.

BRIEF DESCRIPTION OF THE DRAWINGS

The above and other objects and advantages of the invention will be apparent upon consideration of the following detailed description, taken in conjunction with the accompanying drawings, in which like reference numerals refer to like parts throughout, and in which:

FIG. I is a partially fragmentary perspective view of an illustrative embodiment of a non-burning article made in accordance with the principles of this invention;

FIG. 3 is a longitudinal sectional view of another illustrative embodiment of a non-burning article constructed in accordance with this invention;

FIG. 6 is a longitudinal sectional view of another illustrative embodiment of a non-burning article constructed in accordance with this invention;

DETAILED DESCRIPTION OF THE INVENTION

Figure 1:
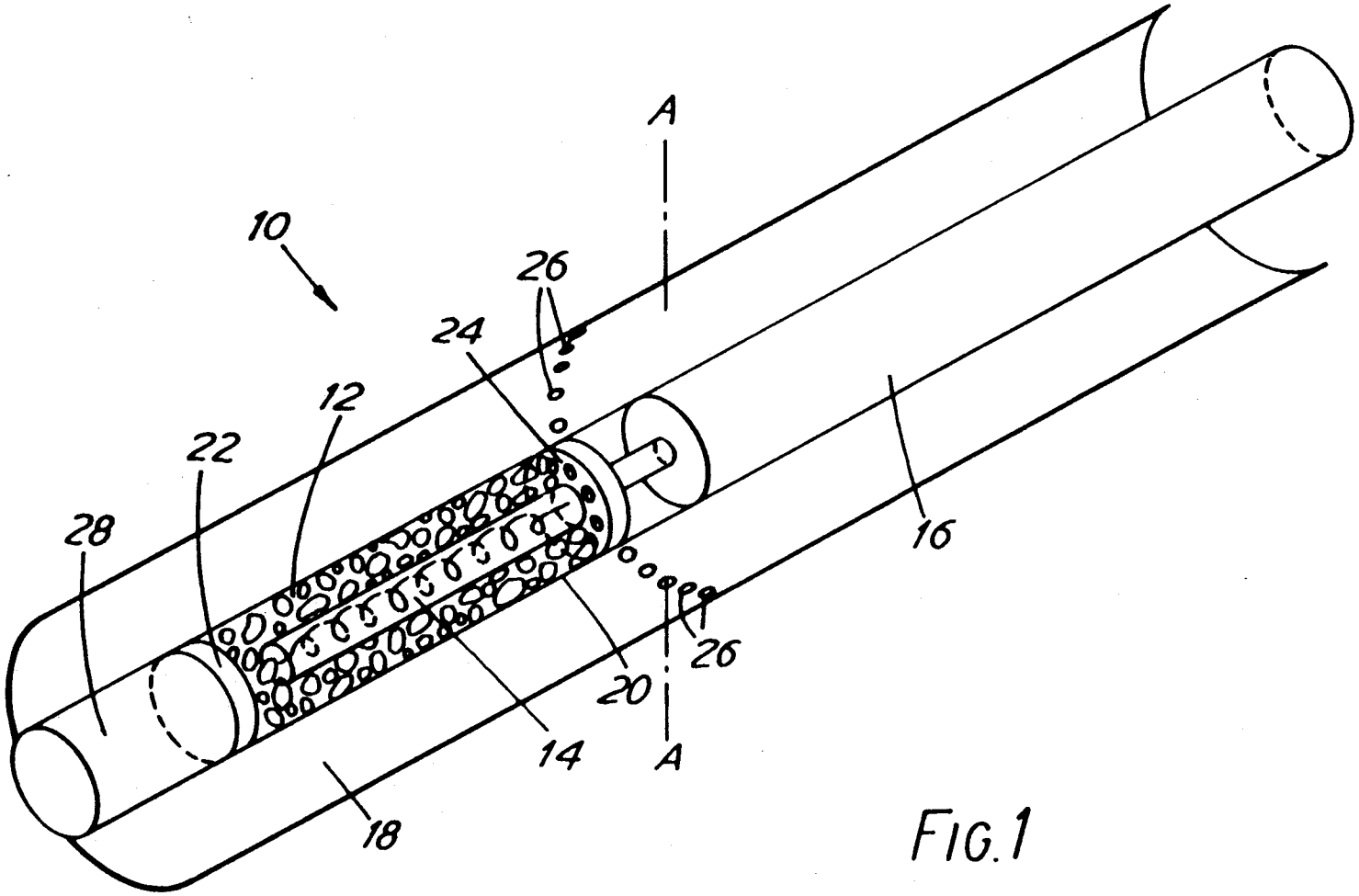

Referring now to the drawings, FIG. I shows an article, designated generally by reference numeral 10, which typically includes flavor-generating medium 12, a heating element 14, and a power source 16, which are surrounded by an outer tube or overwrapper 18. Flavor-generating medium 12 typically may be formed in a packed bed or as an extruded rod disposed around heating element 14, and is then typically encased in an inner, thermally-insulating tube 20. Flavor-generating medium 12 is captured within tube 20 by perforated front and rear clips 22 and 24, respectively. Electrical energy from power source 16 is applied to the terminals of heating element 14, which heats the flavor-generating medium to produce flavor components. Air holes 26 are provided in outer wrapper 18 to permit outside air to be drawn through flavor-generating medium 12. The outside air mixes with the flavor components, and the mixture is drawn through front clip 22 and filter 28 when the consumer draws on the article. Article 10 is separable along line A—A to permit the consumer to replace expended flavor-generating medium and filter materials, and to access power source 16.

Figure 2:
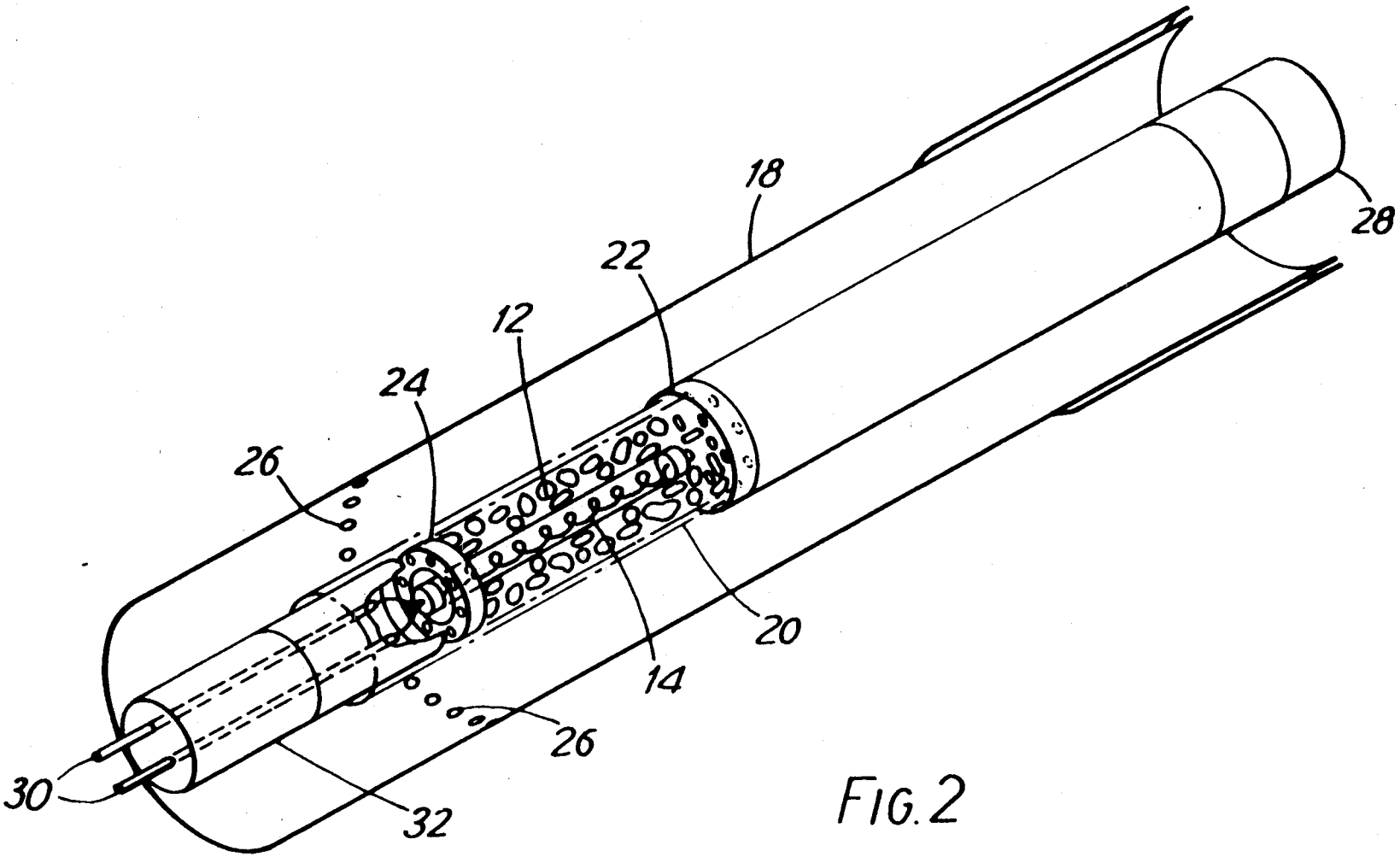
FIG. 2 is an alternative embodiment of the non-burning article of FIG. 1.

FIG. 2 shows an alternative embodiment of article 10 in which energy is supplied to heating element 14 from an external source rather than from internal power source 16. Energy is transmitted to the contacts of heating element 14 via connector pins 30. A heater base 32, which partially extends within tube 20, supports and properly positions connector pins 30. Energy may be supplied to connector pins 30 through wires extending to an external power source, permitting article 10 to be operated while the power is connected. Alternatively, the article may be plugged directly into the external power source while heating and then removed from the power source for use. One skilled in the art could modify the embodiments of the articles described herein to utilize either internal or external power sources.

Flavor-generating medium 12 typically is placed around heating element 14. Alternatively, the heating element may surround the flavor-generating medium. Flavor components are released from medium 12 when the temperature of medium 12 has been raised to between about 100° C. and 500° C. The preferred temperature range for generating flavor components is between 120° C. and 400° C., and the most preferred range is between 200° C. and 350° C. The amount of flavor components produced by the article, and consequently, the amount of flavor released, depends upon the temperature, quantity, and concentration of flavor-generating medium 12. Flavor-generating medium 12 may be similar to the flavor pellets shown in commonly assigned U.S. patent application Ser. No. 07/222,831, filed Jul. 22, 1988, hereby incorporated by reference in its entirety. Flavor-generating medium 12 may include tobacco or tobacco-derived materials. Alternatively, medium 12 may be peppermint, fruit flavors, or other similar flavors.

Heating element 14 may be formed using a variety of materials. In a preferred embodiment, heating element 14 is a resistive wire coil (such as tungsten, tantalum, or an alloy of nickel, chromium, and iron (such as that sold by Driver-Harris Company, Harison, N.J., under the trademark NICHROME ®) disposed within an insulating tube which typically may be paper, foil, carbon, plastic, or glass. Alternatively, the heater may be formed with graphite or ceramics, and can be formed with a protective sheath of these materials.

The heating element is designed to heat flavor-generating medium 12 directly or to heat outside air before it is drawn through medium 12. Referring now to FIG. 3, article 34 includes a first heating element 14 in contact with flavor-generating medium 12, and a second heating element 14' for preheating air drawn into tube 20 before it enters bed 12. When a puff is drawn on filter 28, outside air is drawn through air holes 26 formed in outer wrapper 18. The air is drawn through a passageway 36 which is formed between outer wrapper 18 and thermally-insulating tube 20 by spacer rings 38 and 40. The air exits passageway 36 and enters tube 20 via air holes 42, and is drawn past heater 14' and through the heated flavor-generating medium. The mixture of heated air and flavor components is drawn through filter 28 for the consumer's use.

A controlled flavor-generating medium temperature (or a consistent heating temperature in a pulse-heated system) is required to ensure a substantially consistent release/generation of flavor components. Flavor-generating medium 12 typically is maintained at a controlled temperature by means of a control system. Control systems suitable for use with this invention may be either "passive" systems or "active" systems. A passive control system is one that uses heating element 14 or power source 16 themselves to regulate the temperature of flavor-generating medium 12 or the amount of power applied to the heating element. An active control system uses an additional components such as an electronic control circuit, or requires participation from the consumer, to consistently heat the flavor-generating medium.

In a preferred embodiment of the invention, the article utilizes a passive, coupled system to control the heating process and to control the amount of flavor component generated. The characteristics of the components in the coupled system are selected to maintain flavor-generating medium 12 at a controlled temperature throughout operation. The critical components of the coupled system include flavor-generating medium 12, heating element 14, and power source 16. This type of coupled control system is most effective in articles which have a self-contained power source.

The coupled system works as follows. Power source 16 discharges electrical energy to heating element 14. Heating element 14 converts the discharged electrical energy into heat. The thermal masses and material properties of heating element 14 and flavor-generating medium 12 rapidly absorb the heat and prevent smoking article 10 from overheating. More energy is released at the beginning of operation, when power source 16 is fully charged. After a short period of operation, power output from power source 16 is reduced, because the power source has discharged most of its potential energy and because the internal resistance of power source 16 rises (due to its self-heating properties). The discharge characteristics of power source 16 change due to the discharge of energy to the heating element, and due to losses internal to the power source. Because flavor-generating medium 12 and heating element 14 retain heat generated during the initial high-energy discharge of power source 16, the temperature of flavor-generating medium 12 remains substantially constant, even as the electrical energy output of power source 16 is reduced. When the electrical energy of power source 16 is depleted, flavor-generating medium 12 may be removed and replaced with fresh material, and power source 16 may be recharged, prior to reuse.

A change in any one component of the coupled system affects the performance of the other components. Flavor-generating medium 12, heating element 14, and power source 16 must be empirically tailored to select the desired operating temperature of article 10. For example, a heating element having a lower resistance and lower mass would allow more current to flow, and would allow flavor-generating medium 12 to heat more quickly. Also, the thermal characteristics of flavor-generating medium 12 vary with the size and quantity of the pellets forming the flavor-generating medium. Increased surface area, resulting from smaller pellet size, permits flavor-generating medium 12 to absorb thermal energy at a quicker rate by providing more contact with the heating element and adjacent particles.

The amount of total particulate matter (TPM) released from a given flavor-generating medium is proportional to the time temperature history of the medium. For example, heating a 100 milligram sample of the material at 120° C. typically can release two milligrams of TPM in a given time period. The same sample, heated to 280° C. for the same amount of time, releases 22 milligrams of TPM. Thus, the delivery of the article may be regulated by selecting components of the coupled system to achieve a predetermined temperature.

In an equally preferred embodiment, heating element 14 is a positive temperature coefficient thermistor. A thermistor is a temperature-sensitive resistor which provides passive temperature control. When the thermistor reaches a predetermined temperature (i.e., the so-called "transition temperature" of the thermistor), its electrical resistance greatly increases, reducing current flow through the thermistor and therefore the heating. If the temperature of the thermistor decreases, the electrical resistance also decreases, causing additional current to flow and heating to increase. The thermistor maintains a constant bed temperature by continually adjusting the current flow in response to thermistor temperature (and flavor-generating medium temperature). Positive temperature coefficient thermistors suitable for use in the present invention are commercially available, for example, from Murata Erie North America, 220 Lake Park Drive, Smyrna, Ga. 30080 (thermistor part No. PTH420AG1000N032).

Figure 4:
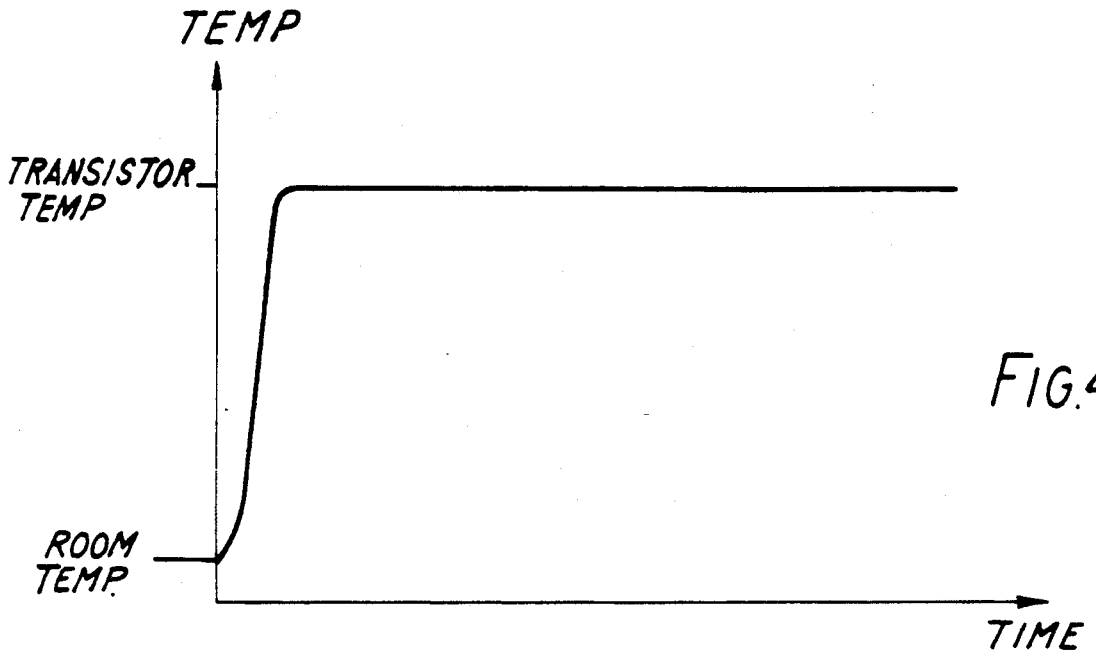
FIG. 4 is a graph of the temperature characteristic of a typical thermistor used as a heat source for the non-burning article of this invention.

FIG. 4 is a graph of the temperature characteristic of a typical positive temperature coefficient thermistor. By selecting the appropriate thermistor, the transition or stabilization temperature may be selected to achieve a desired flavor strength for the article. FIG. 4 illustrates the rapid heating abilities of the thermistor. Because of its chemical composition, the positive temperature coefficient thermistor functions as a self-regulated heating device.

There are several advantages to heating the article with thermistors rather than conventional resistance heaters. Articles having thermistors do not require thermostats or control circuits to prevent overheating, provide a controlled surface temperature independent of ambient conditions, and provide a stable temperature almost independent of the supply voltage. These features make the device an excellent choice for heating flavor-generating media in articles because it provides a consumer with a relatively consistent delivery of flavor from puff to puff.

Figure 5:
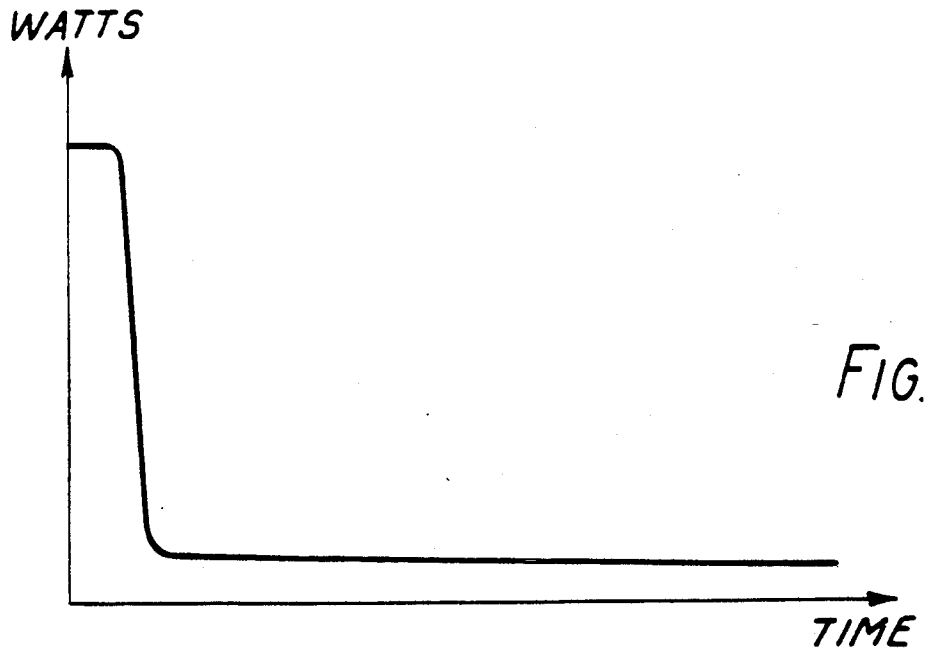
FIG. 5 is a graph illustrating the power consumed by a thermistor to achieve and maintain the temperatures depicted in FIG. 4.

FIG. 5 is a graph of the power consumed by the thermistor to produce the temperatures shown in FIG. 4.

Articles of the present invention may utilize active control systems to regulate operation. One preferred system is a double heater/pulse design, shown in FIG. 6. A first heating element 14 maintains the temperature of flavor-generating medium 12 at a substantially constant temperature, below the temperature to which flavor-generating medium 12 must be heated to generate the desired aerosol. A second heating element 14' is pulsed with electrical energy to raise the temperature of the medium above the vaporization temperature to produce the desired flavor components.

Flavor-generating medium 12 is captured within tube 20, which may be a metal or other thermally conductive container. Heating element 14 surrounds and can be in thermal contact with tube 20 to heat the contents of the tube. Heating element 14 preferably heats the air drawn through passageway 36 before the air is drawn into tube 20. Heating element 14', which typically may be disposed within flavor-generating medium 12, is pulsed for a predetermined period with electrical energy from power source 16 to generate/release flavor components for each puff.

The double heater/pulse design of FIG. 6 provides two distinct advantages. First, less energy is required from power source 16 to provide the same flavor-generating capability as a constant temperature system. The flavor-generating medium is maintained at a lower temperature for most of the operating period. A high temperature is not maintained; flavor-generating medium 12 is pulsed to the higher temperature for short periods, which consumes less energy. Second, the flavor components are generated in the short time period immediately prior to, and/or during puffing with only nominal amounts of flavor components accumulated between puffs. This results in an improved flavor component delivery.

A more preferred embodiment of article 10 includes only a single heating element which contacts flavor-generating medium 12. The heating element provides both the constant, low-level heating between puffs, and the high temperature pulse for each puff.

Figure 7:
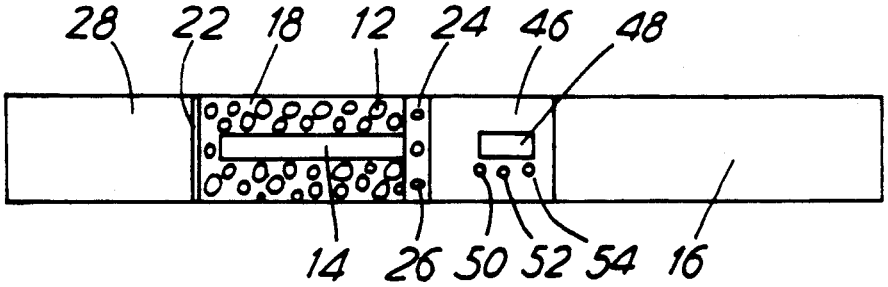
FIG. 7 is a partially fragmentary longitudinal sectional view of an illustrative embodiment of a non-burning article constructed in accordance with this invention having an active control circuit.

A second type of active control system, shown in the smoking article 44 of FIG. 7, is an electronic control circuit 46 which regulates power delivered to a single heating element 14. Circuit 46 provides a predictable method for applying voltage and current to heating element 14, and thus for controlling the temperature of flavor-generating medium 12. Control circuit 46 has two operating modes for efficient power use: a "low power" mode for maintaining flavor-generating medium 12 at a predetermined low-level temperature (below the vaporization temperature) between puffs, and a "high power" mode for rapidly raising heating element 14 to its preferred, higher operating temperature. Circuit 46 typically provides a fixed lock-out time between high power operations to prevent inadvertent over-heating of flavor-generating medium 12 by frequent high power operation.

Circuit 46 is connected to power source 16 by a double-pole, double-throw switch 48, which is shown in the "off" position in the drawing. When switch 48 is placed in the "on" position, the positive terminals of power source 16 is connected to the input terminals (pin 1) of voltage regulators 56 and 58. Regulators 56 and 58 are standard, commercially available integrated circuits (such as Models 7508 and LM317T, available from Radio Shack, Division of Tandy Corporation, Fort Worth, Tex.). The negative terminal of power source 16 forms a ground reference for the circuit.

To operate smoking article 44, the consumer sets power switch 48 to the "on" position. Article 44 operates initially in the high power mode. Flavor-generating medium 12 is quickly heated to its preferred, higher temperature, enabling the consumer to puff article 44. When the time interval for the high power mode elapses, control circuit 46 enters the low power mode to maintain flavor-generating medium 12 at a reduced temperature. The consumer is prevented from initiating the high power mode for a predetermined lock-out period, to prevent overheating the smoking article. When the lock-out period has elapsed, the consumer may re-enter the high power mode by actuating a switch 50. The cycle is repeated each time switch 50 is actuated. When the consumer has finished, the expended flavor-generating medium may be replaced in preparation for the next use of the device.

Circuit 46 includes two timing circuits 60 and 62, which are based on standard (low power) integrated circuit (IC) timers 64 and 66 (such as Model TLC555, also commercially available from Radio Shack). Timing circuits 60 and 62 control the low power and high power modes of operation, respectively. Voltage regulator 56, with pin 3 connected to ground, regulates the voltage to the resistor-capacitor (RC) network that determines the duration of the high power lock-out period.

Resistor 68 connects the output and voltage adjust pins (pins 2 and 3, respectively) of voltage regulator 58, causing regulator 58 to function as a current limiter when circuit 46 operates in the low power mode. The output of regulator 58 is bypassed during the high power mode.

The regulated output voltage (pin 2) of voltage regulator 56 is connected to the positive power terminal (pin 8) of timer 64 and to an RC network. The negative power terminal (pin 1) of timer 654 is grounded. The RC network includes a variable resistor 70, a fixed resistor 72, and a capacitor 74. The output of timer 64 (pin 3) is controlled by the RC network and is triggered by a negative pulse on pin 2, which in turn, is caused by grounding pin 2 through switch 50. The charging time is determined by the values of resistors 70 and 72, and capacitor 74, which are selected to obtain a charging time which typically may be in the range of about five to about thirty seconds, and preferably between ten and twenty seconds, and most preferably fifteen seconds.

Switch 50 is connected to the RC network between resistor 72 and capacitor 74 on one side, and is grounded on the other. Switch 50 discharges capacitor 74 when actuated, resetting the charging time of circuit 60 to zero, and generating an output at pin 3 of timer 64. When the voltage on capacitor 74 exceeds two-thirds of the supply voltage, the high power lock-out period elapses, and the consumer may again cause the circuit to enter the high power mode (to generate flavor components).

Pin 2 (regulated output voltage) of regulator 56 connects to timing circuit 62 through the normally-open contacts of relay 76., When the output from pin 3 of timer 64 is high, the coil of relay 76 is energized, and the relay contact is closed. Power is then supplied to timing circuit 62. Timing circuit 62 includes timer 66 and a second RC network which includes variable resistor 78, fixed resistor 80, and capacitor 82. The charging time of the second RC network is determined by the values of resistors 78 and 80, and capacitor 82, which are selected to obtain a charging time which typically may be in the range of about 0.2 to about 4.0 seconds, preferably between 0.5 and 2.0 seconds, and most preferably between 1.2 and 1.6 seconds. This charging time controls the duration of the high power mode. The output of timer 66 (pin 3) is controlled by the second RC network, and becomes high when the voltage at pin 2 of timer 66 drops below one-third of the supply voltage. Pin 7 of timer 64 provides a discharge path for capacitor 82, to trigger the output at pin 3 of timer 66 and to reset timing circuit 62.

Variable resistors 70 and 78 permit adjustment of the charging time for timing circuits 60 and 62, respectively. In an alternative embodiment, resistors 70 and 72 and resistors 78 and 80 are replaced with a respective one of a single, fixed resistor. If the desired charging times are known and fixed, it is advantageous to use a single, fixed resistor for each pair, to reduce the size and complexity of circuit 46.

The output of timer 66 (pin 3) is connected to the coil of relay 86, and therefore controls the voltage across the coil of relay 88. Relay 88 controls whether heating element 14 is heating in the low power or high power mode, by controlling the voltage across output terminals 90. Relay 88 switches either the regulated current output of voltage regulator 58 (low power mode) or the positive voltage of power source 16 (high power mode) to output terminal 90. The contact of relay 88 is normally switched to terminal a, which is connected to the regulated current output (pin 2) of regulator 58. Terminal b of relay 88 is connected to the positive terminal of power source 16, through power switch 48. When relay 86 is energized, current flows from power source 16 and through relay 86, energizing the coil of relay 88. The contact of relay 88 then switches to terminal b. LED 54 connects the common contact of relay 88 with series resistor 92 (the resistor's second terminal is grounded). Resistor 92 is selected such that LED 54 is illuminated only during the high power mode.

Changing any component of control circuit 46 will affect the performance of the entire circuit, and thus affect the operation of article 44. In particular, changing the values of the resistors and capacitors which form the first and second RC networks of timing circuits 60 and 62 will alter the charging times of these circuits, and thus alter the duration of high power operation and the duration of the high power lock-out period. The optimal duration of each time interval is determined primarily y the characteristics of flavor-generating medium 12 and heating element 14. For example, a heating element having a lower electrical resistance would allow more current to flow, and would allow the flavor-generating medium to heat more quickly. This, in turn, might allow for a shorter high power operation.

A third type of active control system uses a temperature-sensing feedback loop to control the heating cycles applied to flavor-generating medium 12. For example, temperature-sensing devices such as thermocouples, thermistors, and resistive temperature devices (RTDs) may be used to sense temperature and regulate the power flowing to the heating element to maintain a predetermined temperature. An illustrative embodiment of this control system is shown in FIG. 8*a*.

Figure 8A:
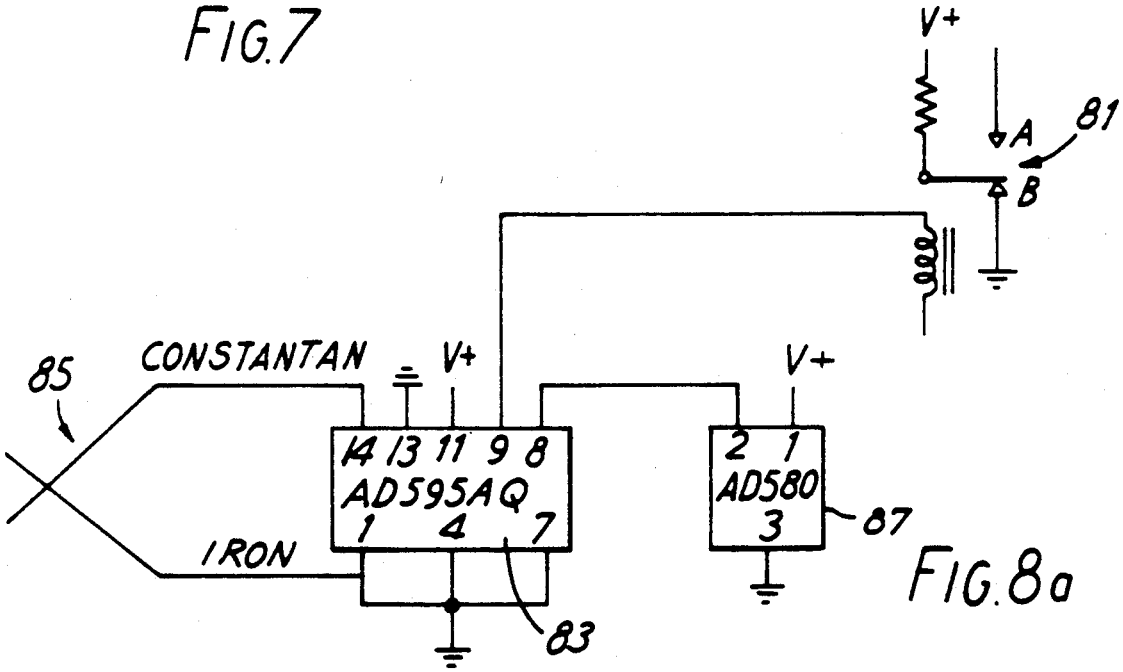
FIG. 8*a* is an schematic diagram of an alternative active control circuit.

Referring now to FIG. 8*a*, heating element 14 is connected directly to a voltage supply, and is grounded through a normally-closed contact of a single pole, double throw relay contact 81. The relay is actuated under the control of a switched output set point controller 83 (Model AD595, manufactured by Analog Devices, Norwood, Mass.) via pin 9. The controller 83 is connected to the voltage supply via pin 11, and is grounded via pins 1, 4, 7, and 13. A "K" type thermocouple 85 has an iron and a constantan pin, which are connected to pins 1 and 14 of controller 83, respectively. Controller 83 is connected (via pin 8) to an output voltage of about 2.5 volt from pin 2 of a voltage regulator 87 (Model AD580, manufactured by Analog Devices, Norwood, Mass.). Voltage regulator 87 is connected to a voltage supply via pin 1, and is grounded via pin 3.

When power is initially switched on, current flows through the heater until the predetermined temperature, set by the voltage reference (at pin 8), is reached. If the voltage reference is 2.5 volts, the set point temperature is 250° C. (the temperature set point corresponds to approximately 100° C. per volt). Once the set point temperature is reached, the output of controller 83 is equal to the supply voltage, and the relay is energized. At this point, the normally-closed relay contact opens, causing the current flow through the heater to cease. The temperature will then drop below the set point temperature, causing the relay to deenergize, closing the normally-closed contact. This feedback cycle continues, maintaining the heater temperature at about the set point temperature.

The set point temperature of the circuit of FIG. 8*a* can be varied by changing the set point voltage at pin 8 of controller 83. The components of this circuit could be changed to accomplished the same goal. For example, either a solid state relay or transistors could be used in place of relay 81. Also, a custom integrated circuit could be made which incorporates all of the functions in the discrete circuit. This type of circuit could be modified to use an RTD, or other temperature sensors and transducers, in place of thermocouple 85.

Power can be supplied to the articles of this invention in a variety of ways. Broadly classified, power source 16 may be an internal or an external source. Internal power sources are disposed within the article (see FIG. 1), creating a self-contained system. External sources are disposed exterior to the article, and typically are connected to the article (FIG. 2) via connecting pins 30.

Internal power sources 16 typically are rechargeable nickel cadmium (NiCd) batteries, because NiCd batteries discharge power relatively consistently throughout the discharge cycle. However, power source 16 may be any rechargeable or disposable battery, such as a rechargeable lithium manganese dioxide battery or a disposable alkaline battery. Power source 16 typically has sufficient capacity to supply 20–500 milliamp-hours, and to produce a voltage of 2.4 volts. In a preferred embodiment, power source 16 is two, 1.2 volt, 80 milliampere batteries, connected in series. Batteries of this capacity are capable of powering a single, "10-puff" article. These batteries will provide sufficient energy for approximately five minutes of operation.

Figure 9:
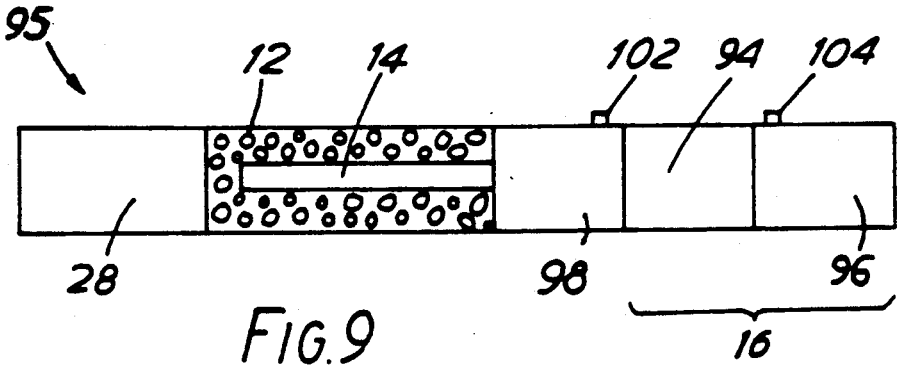
FIG. 9 is a longitudinal sectional view of an illustrative embodiment of a non-burning smoking article which uses a capacitor and battery as a power supply.
Figure 8:
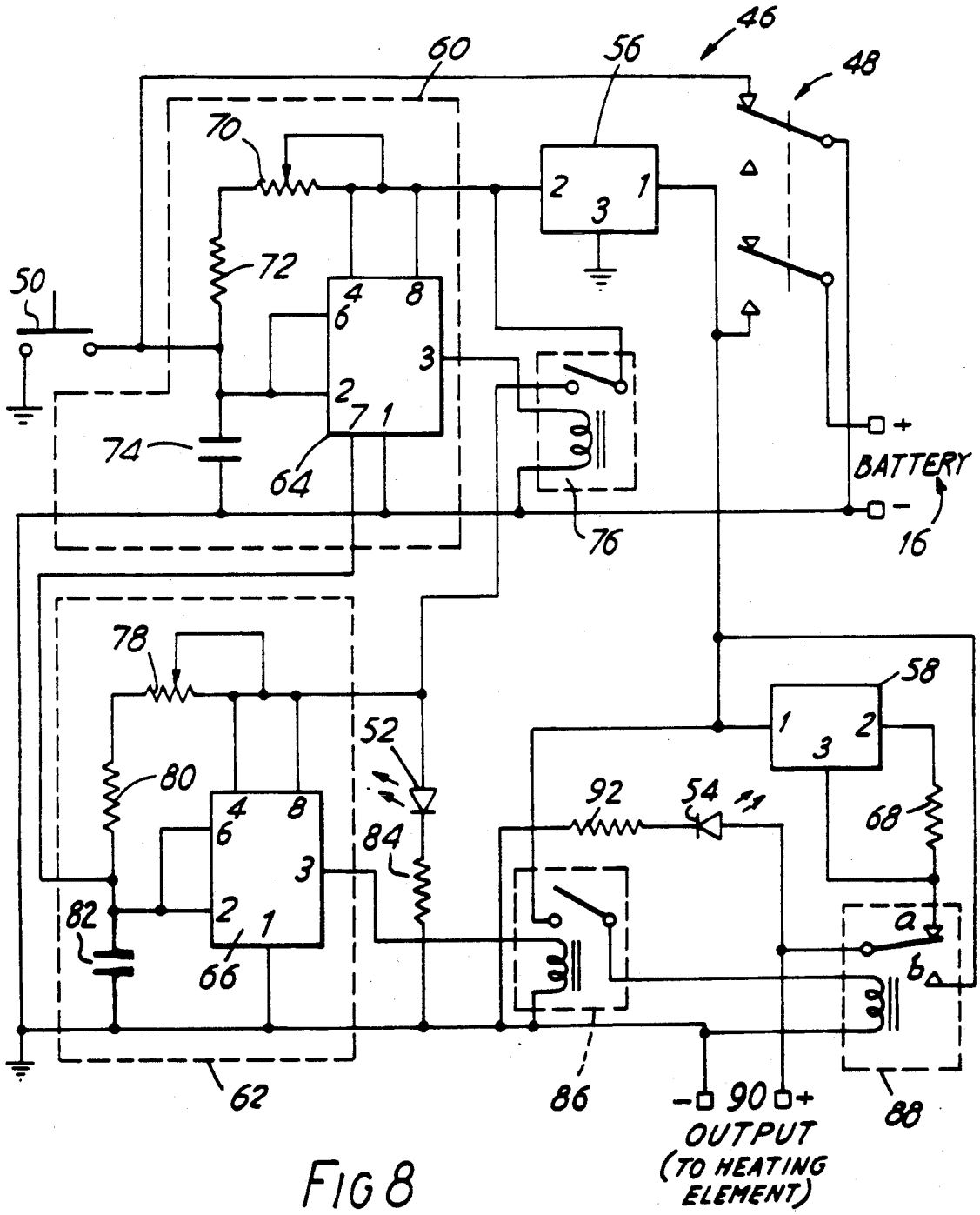
FIG. 8 is an illustrative embodiment of the active control circuit of the article of FIG. 7.

In an alternative embodiment of the smoking article, designated generally by reference numeral 95 and shown in FIG. 9, power source 16 includes a capacitor 94 and a battery 96 for charging the capacitor. Battery 96 may be discharged slowly, in the period between puffs, to charge capacitor 94. Unlike a capacitor, a battery is not well suited to quickly discharge stored energy. Battery 96 may power a significantly greater number of puffs when it is slowly discharged rather than quickly discharged. The battery/capacitor combination enables the use of batteries smaller in size and capacity, and permits the consumer to charge the battery less frequently than would be possible without the capacitor.

In another alternative embodiment, energy is coupled to the article by magnetic or electromagnetic induction, and rectified and conditioned prior to charging the capacitor. The external power source typically may be a specially designed ashtray containing a suitable generator and inductor for coupling the magnetic or electromagnetic energy to the article.

Capacitor 94 delivers a predetermined amount of energy to heating element 14 to provide a controlled delivery for a single puff. Capacitor 94 is recharged between each puff to minimize the charge storage capacity required. Capacitor 94 discharges the maximum energy early in the discharge cycle, quickly raising the temperature of flavor-generating medium 12 to the pulse temperature. As capacitor 94 discharges, the operating voltage of the capacitor reduces, causing a correspondingly reduced energy release. The reduced energy release maintains the heating element temperature and flavor component generation.

Capacitor 94 must have sufficient capacitance to store enough energy to power the heating pulse for a single puff. The capacitance and resistance of heating element 14 must be selected to establish a desired capacitor discharge time constant. Capacitors suitable for use in accordance with the present invention may be selected according to the following equation:

$$C=2E/V^2,$$

where:

C is the capacitance of capacitor 94;

E is a predetermined amount of energy required to power a predetermined number of puffs; and V is a predetermined battery voltage.

The proper resistance of heating element 14 is obtained by dividing the desired time constant (discharge rate of capacitor 94) by the capacitance of capacitor 94.

Figure 10:
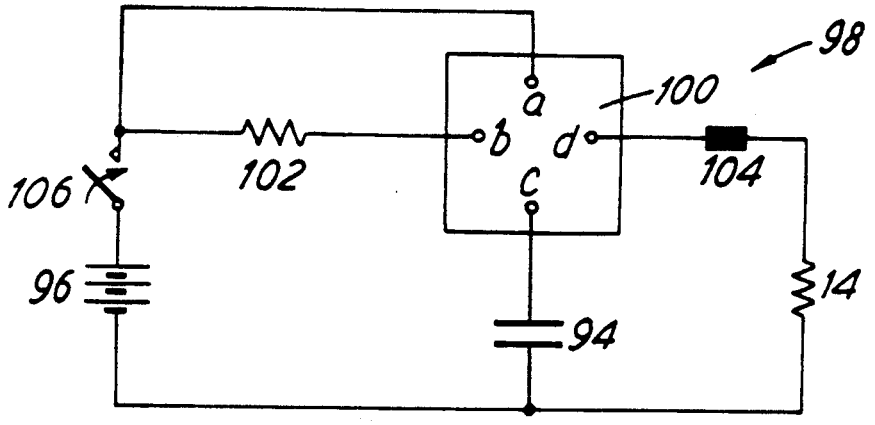
FIG. 10 is a schematic diagram of the electrical connections for the article of FIG. 9.

Referring to FIGS. 9 and 10, battery 96 charges capacitor 94. A control circuit 98 (FIG. 10) typically connects capacitor 94, battery 96, and heating element 14 through a control switch 100. When switch 100 is initially actuated, the switch connects poles b and c, to charge capacitor 94. Switch 100 simultaneously connects poles a and d to connect the battery to heating element 14, through a current or voltage limiting device, to raise the heater temperature. Heating element 14 raises the temperature of flavor-generating medium 12 to a standby, low temperature, not exceeding the preferred temperature for flavor component production.

To puff article 95, the consumer operates switch 100 to disconnect poles a and d, and poles b and c. The switching operation may be initiated automatically during puffing by a pressure or flow sensor that senses the beginning of a puff. Switch 1090 then connects poles c and d, to discharge capacitor 94 through heater 14. Article 95 typically is designed such that the capacitor discharge is matched to the electrical requirements of heating element 14, and the desired heating is accomplished without additional control circuitry. However, additional power control or shaping circuitry may be inserted between poles c and d to modify the capacitor discharge characteristics. When capacitor 94 is discharged, poles c and d are disconnected, and poles a and b are again connected to poles d and c, respectively.

The circuit of FIG. 10 may include additional elements, such as resistors, fuses, or switches to modify or control the energy transfers within the circuit. For example, a resistor 102 may be connected in series between battery 95 and pole b, and in parallel with the lead to pole a to modify the capacitor charging characteristics of the circuit. Resistor 102 is selected to increase the time constant of the charging circuit, thereby reducing the charging rate of capacitor 94. A fuse 104 may be disposed between heating element 14 and pole d of switch 100 to ensure that excessive energy levels are not delivered to the heating element. A user-actuated switch 106 may be connected to battery 95 to prevent inadvertent discharge from the battery.

The delivery of article 95 may be regulated in several ways (in addition to the methods already described). The level of capacitor recharge may be regulated, thereby controlling the energy available to heating element 14. Alternatively, control circuitry may be used to regulate the current or total power flowing to or from the capacitor.

Figure 11:
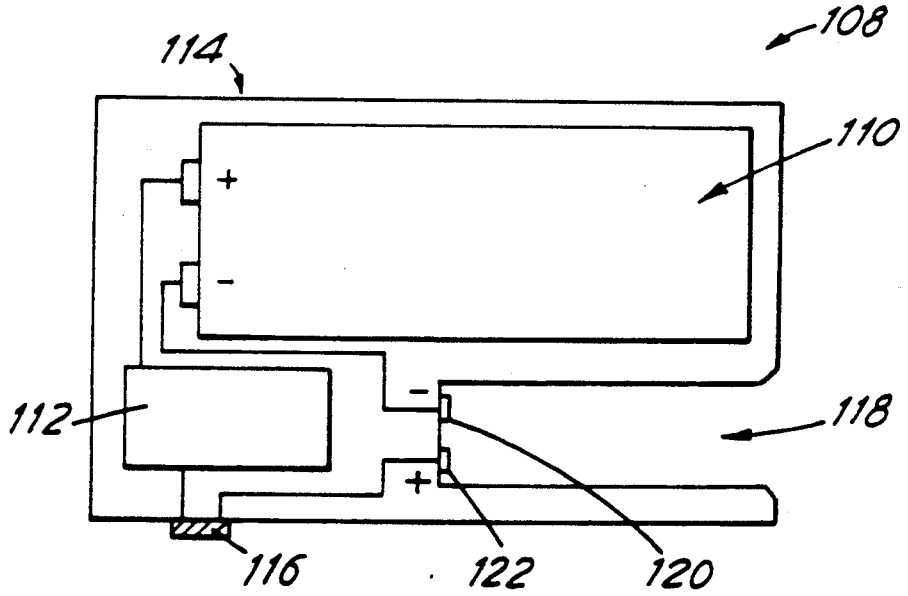
FIG. 11 is a partly schematic diagram of a device constructed in accordance with this invention for supplying electrical energy to the articles of this invention.

FIG. 11 shows an illustrative embodiment of a device used to charge the battery of power source 16 (e.g., for the article of FIG. 1). The charging device, designated generally by reference numeral 108, includes a battery 110 and a control circuit 112, disposed within case 114. Control circuit 112 regulates the amount of energy delivered from battery 110 to power source 16. Charging device 108 may also include a switch 116 to permit a consumer to manually control the operation of device 108.

A recess 118 may be provided within case 114 to accept a portion of the article (i.e., power source 16) for charging. The edges at the entrance to recess 118 typically are bevelled to facilitate positioning of the article within the passageway. Article 10 must be oriented such that the positive terminal of battery 110 is electrically connected to the positive terminal of power source 16. Recess 118 is provided with means for ensuring proper orientation of the article when the article is placed in the recess for charging. In an illustrative embodiment, visual markings are provided on recess 118 and on the article. When the visual markings are properly aligned, the power source 16 is properly positioned for charging.

Battery 110 of device 108 is electrically connected in series with charging contacts 120 and 122. Contacts 120 and 122 provide a path for electricity to flow to the contracts of power source 16. Battery 110 typically has sufficient capacity to power ten to twenty articles (i.e., battery 110 has sufficient capacity to recharge the battery of power source 16 ten to twenty times) before battery 110 must be recharged or replaced. Battery 110 has a high voltage to facilitate quickly recharging power source 16. Battery 110 typically is a rechargeable lithium or nickel cadmium battery.

When a consumer properly positions the power source portion of the smoking article within device 108, power source 16 will begin to charge. To achieve optimum charging, the charge rate and control circuitry must be tailored to the characteristics of the specific power source being charged. To reduce the waiting period and inconvenience to the consumer, a fast charging rate is desirable. In a preferred embodiment of this invention, battery 110 charges power source 16 at approximately one-third of the capacity rate (i.e., at a rate of 83 milliamps for a 250 mAH battery pack). Charging at this faster rate, or at even faster rates (which are possible with the appropriate control circuit), necessitates the use of control circuitry to prevent overcharging and damaging power source 16.

Control circuit 112 regulates the electrical energy transferred from battery 110 to power source 16. Circuit 112 permits power source 16 (e.g., a nickel cadmium battery) to be charged at a fast rate. Circuit 112 may operate in a variety of ways. In one embodiment, circuit 112 includes a relay which disconnects the power to contacts 120 and 122 when power source 16 has been charged to a predetermined level or switches to a trickle charge to maintain full charge. Power source 16 is charged to a level that is less than maximum capacity, which typically may be approximately 90 percent of capacity. In an alternative embodiment, circuit 112 converts excess electrical energy to heat energy (i.e., circuit 112 functions as a thermal cut-off). Other control circuits suitable for use in this invention are described in Sanyo CADNICA Technical Data Publication, No. SF6235, pp. 35–40, which is hereby incorporated by reference herein.

Figure 12:
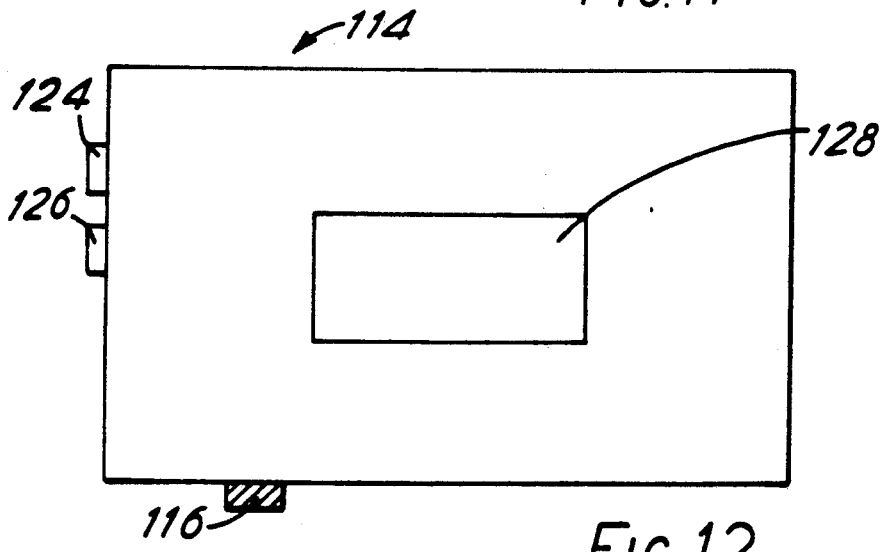
FIG. 12 is an alternative embodiment of the device of FIG. 11.

In an alternative embodiment of the invention, shown in FIG. 12, charging device 108 includes external charging contacts 124 and 126 disposed on the exterior of case 114. Contacts 124 and 126 permit the charging of battery 110 without requiring the battery to be removed from the case. Charging device 108 may also include clip 128 disposed on the exterior surface of case 114. Clip 128 enables the smoker to carry charging device 108 by attaching it, for example, to a pocket, belt, or pocketbook.

Figure 13:
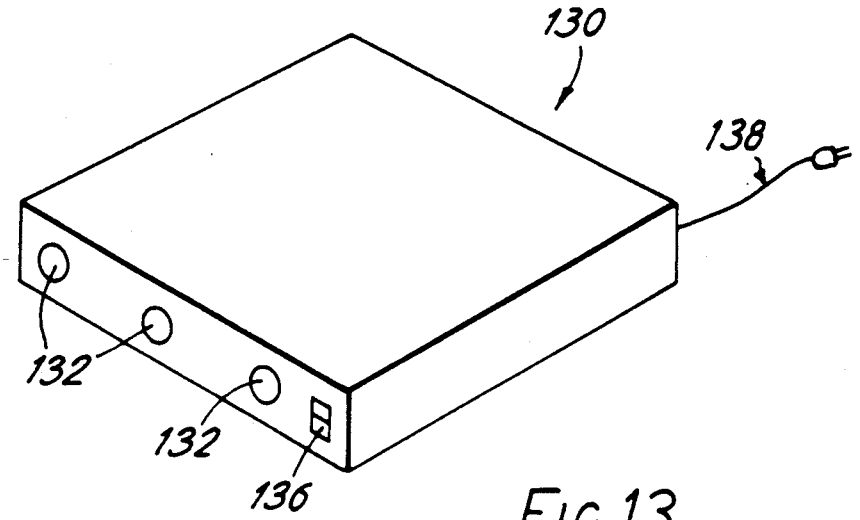
FIGS. 13 and 14 are perspective views of appliance-type devices for supplying electrical energy to the articles of this invention.
Figure 14:
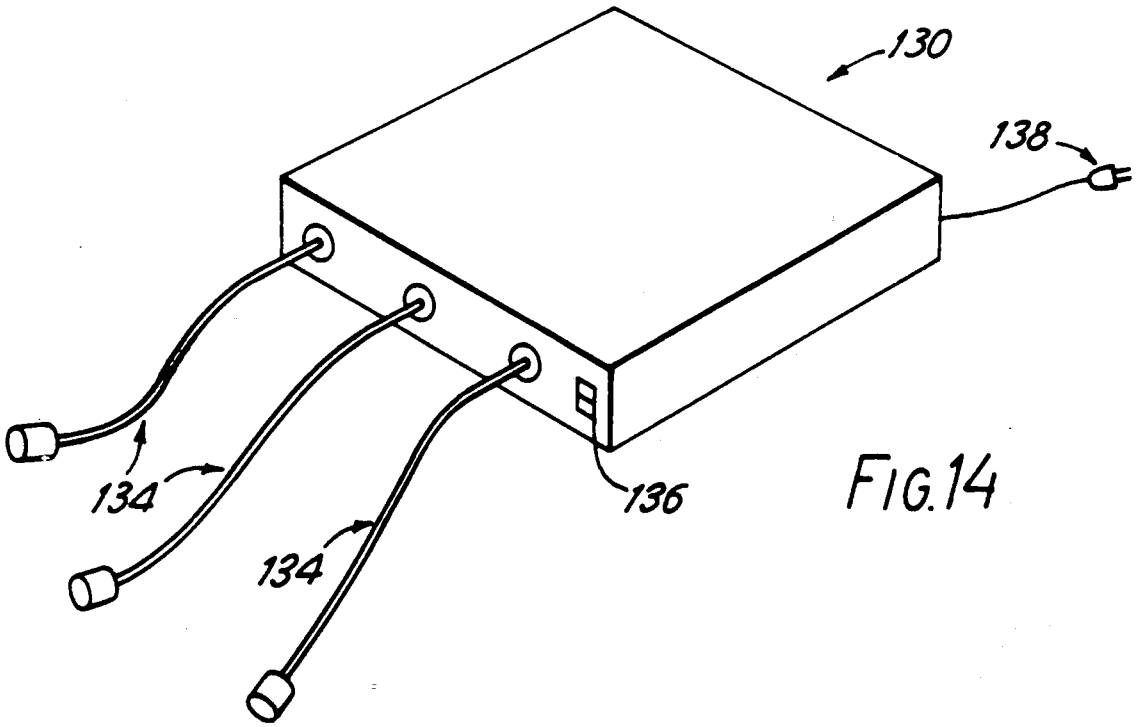

In a further embodiment of the invention, article 10 may be charged or powered using an appliance-type power unit 130 shown in FIGS. 13 and 14. Power unit 130 typically may charge a battery or capacitor within the article, or may supply power directly to the article's heating element using appropriate isolation techniques to prevent shock hazard. This could also include techniques for transferring the energy by inductive coupling, or utilizing Curie point control of the temperature reached by the heating element. Power unit 130 may be used, for example, in meeting rooms, on desktops, or wherever portability is not required. Power unit 130 has one or more recesses 132 to receive either power source 16 or connecting pins 30 of the article (FIGS. and 2, respectively). Alternatively, power unit 130 includes conductive wires 134 for electrically connecting smoking articles to the power unit (via connecting pins 30). Wires 134 conduct electricity to the smoking article while the consumer puffs on the article.

A switch 136 on power unit 130 connects and disconnects power to the articles. Power is supplied to power unit 130 via a conventional power cord and plug 138 from a conventional 120-Volt power source. Power unit 130 includes a transformer and conventional voltage regulating circuitry to provide the appropriate voltage and power output to the articles. Power unit 130 may include control circuitry similar to circuit 112, to prevent overcharging the articles in recesses 132.

If desired, the articles of this invention may include means for indicating that flavor-generating medium 12 has reached the end of its useful life and should be replaced. The indicating means may be a color indicator, which changes to a predetermined color to indicate that the device is finished. Alternatively, the indicating means may be a fusible link which melts to disconnect the power to heating element 14 after a predetermined period of operation (preferably corresponding to the useful life of flavor-generating medium 12).

Figure 15:
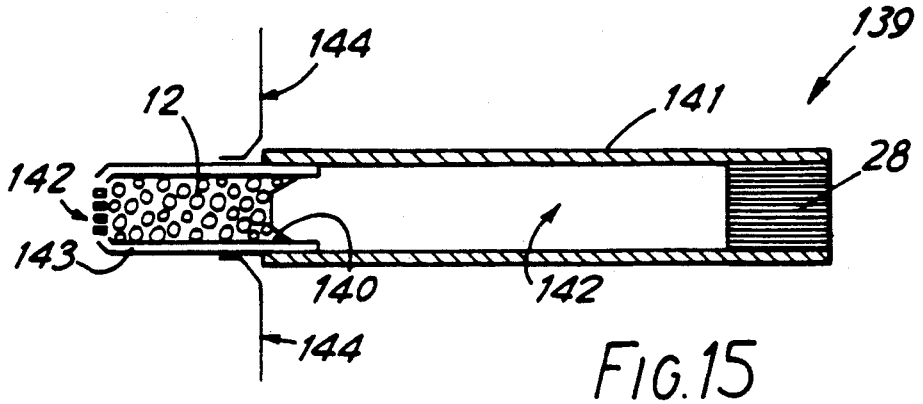
FIG. 15 is a longitudinal sectional view of an alternative embodiment of a non-burning article of this invention.

FIG. 15 shows another alternative embodiment of the article of this invention. Smoking article 139 includes a tube 141, attached to a metal canister 138 and filter 28. Metal canister 143, made preferably of aluminum, is filled with flavor-generating medium 12, and is partly closed by a perforated metal clip 140. Tube 141 and canister 143 are cylindrical in shape. The canister is at the distal end 142, allowing air to be drawn through the perforations, into the tube, and out filter 28. The edges of the metal container typically may be beveled to assist the consumer in inserting the article into the heating apparatus of FIG. 16.

Figure 16:
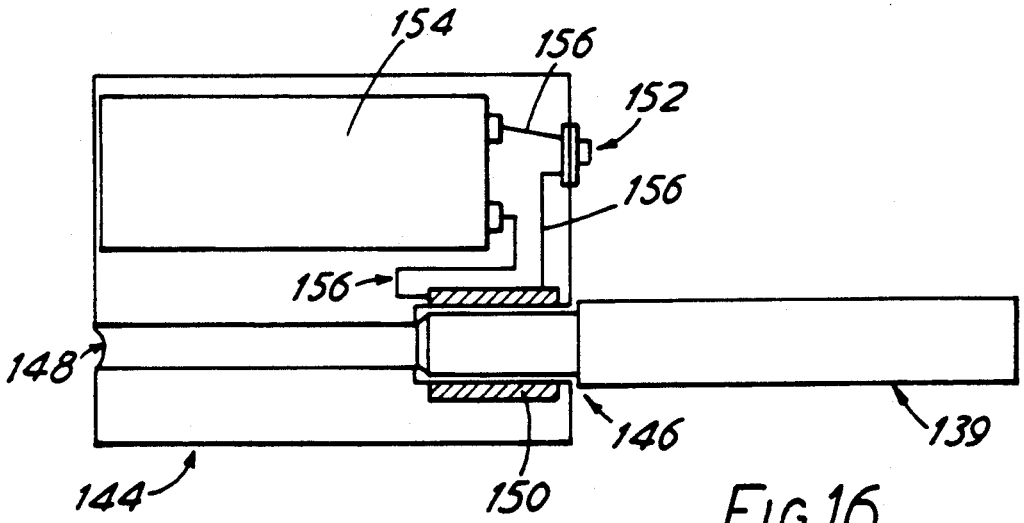
FIG. 16 is a partly schematic diagram of apparatus for heating the article of FIG. 15.

Smoking article 139 does not contain a heating element; it is designed to be kept in the heating apparatus of FIG. 16 during operation. Flavor-generating medium 12 is captured within metal canister 143 to facilitate heat transfer between the heating element and the-flavor-generating medium.

Tube 141 typically is constructed of thermally insulating rigid material, such as cardboard. The tube typically is foil-lined to prevent flavors from escaping during operation. Space 142 allows the air drawn through the heated flavor-generating medium to cool to an acceptable temperature before entering the consumer's mouth.

Figure 17:
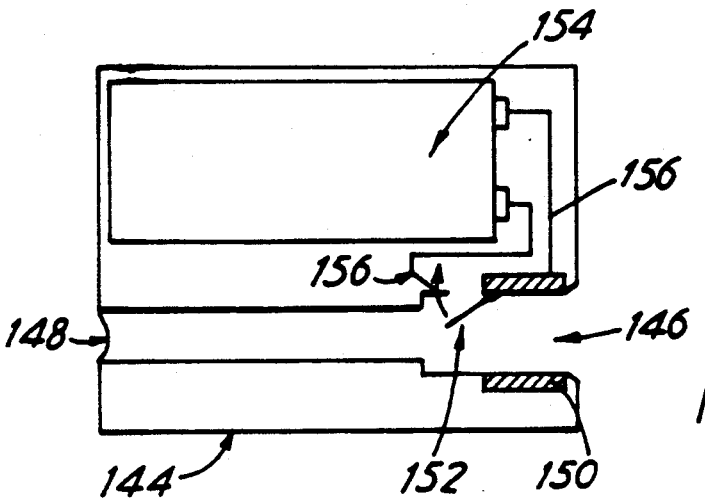
FIG. 17 is an alternative embodiment of the apparatus of FIG. 16.

FIG. 16 shows an illustrative embodiment of apparatus used to heat the article 139 of FIG. 15. The apparatus includes a case 144 having tubular passageways 146 and 148 through case 144 to create a path for air to flow to article 139. The apparatus also includes a heating element 150, which typically may be hollow and cylindrical in shape. Heating element 150 is a self-regulating, positive temperature coefficient thermistor or a conventional resistive element. A switch 152, mounted on case 144, is provided to selectively apply electrical energy to heating element 150 from a power source 154. In an alternative embodiment (shown in FIG. 17), switch 152 may be a pressure-activated switch located inside passageway 146 such that heating element 150 is automatically energized by power source 154 when the article is inserted into passageway 146. In yet another embodiment, canister 148 of article 139 provides a conductive path for electrical power to heating element 150 when the article is properly positioned in passageway 146.

When switch 152 is closed, an electrical circuit is formed between power source 154, switch 152, and heating element 150 via electrical conductors 156. Metal canister 143 of article 139 rests in passageway 146, causing canister 143 to contact the inside surface of heating element 150, thereby heating canister 143 flavor-generating medium 12 to a predetermined temperature. The delivery of article 139 can be regulated by varying the temperature of heating element 150. However, it may be preferable, particularly in embodiments in which the article does not contain a heat source, to regulate flavor strength by varying the quantity or composition of the flavor-generating medium.

Article 139 is received in passageway 146 to be heated, and remains in the passageway throughout operation. Passageway 148, which typically may have a smaller diameter than passageway 146, connects passageway 146 to the outside of case 144. Passageway 148 creates a path for air to be drawn through article 139, and may take any shape or form which accomplishes that result. Passageway 146 and the interior of heating element 150 typically are sized to fit snugly around metal canister 143 for efficient heat transfer, but passageway 146 is preferably slightly different in size than passageway 148, to ensure proper positioning of metal canister 143 against the heating element. The heating device may include a second heating element 156 (FIG. 17) to pre-heat the air as it is drawn through passageway 148. Heating element 156 may be of any desired shape or size, and may be disposed at any convenient point within passageway 148.

It will be understood that the foregoing description is merely illustrative of the principles of the invention, and that various modifications can be made by those skilled in the art without departing from the scope and spirit of the invention. For example, article 10 (FIG. 2) could be powered via charging contacts disposed on the outer surface of and extending annularly around heater base 32. Similarly, contacts 120 and 122 of charging device 108 could be replaced with spring clips designed to contact annular charging contacts on the outer surface of article 10. The present invention is limited only by the claims that follow.

We claim:

1. Apparatus for deriving flavor from a flavor-generating medium comprising:

a positive temperature coefficient thermistor in thermal contact with said flavor-generating medium; and means for selectively applying an electrical current to said thermistor to raise the temperature of the thermistor and thereby heat said flavor-generating medium and cause said flavor-generating medium to release flavor components.

2. The apparatus defined in claim 1 wherein said electrical current raises the temperature of said thermistor to its transition temperature.

3. The apparatus defined in claim 2 wherein the transition temperature of said thermistor is in the range from about 100° C. to about 500° C.

4. The apparatus defined in claim 3 wherein the transition temperature of said thermistor is in the range from about 120° C. to about 400° C.

5. The apparatus defined in claim 4 wherein the transition temperature of said thermistor is in the range from about 200° C. to about 350° C.

6. The apparatus defined in claim I further comprising means for pre-heating air to be drawn over the heated flavor-generating medium.

7. The apparatus defined in claim 6 wherein said means for pre-heating the air comprises a second positive temperature coefficient thermistor raised to its transition temperature.

8. The apparatus defined in claim 1 further comprising means for filtering air and released flavor components.

9. The apparatus defined in claim 1 wherein said flavor-generating medium is a tobacco flavor source.

10. The apparatus defined in claim 1 wherein said means for selectively applying an electrical current is responsive to air passing over the flavor-generating medium.

11. A non-combustion smoking article comprising:

a hollow tube;

a flavor-generating medium disposed within said tube; and a positive temperature coefficient thermistor disposed in said tube and adjacent to said flavor-generating medium for heating said flavor-generating medium and causing said flavor-generating medium to release tobacco flavor components.

12. The article defined in claim 11 wherein said tube is foil-lined.

13. The article defined in claim 1 further comprising means for filtering air drawn through said tube and passed over said flavor-generating medium.

14. The article defined in claim 1 wherein said thermistor has a transition temperature in the range from about 100° C. to about 500° C.

15. The article defined in claim 14 wherein said thermistor has a transition temperature in the range of about 120° to about 400° C.

16. The article defined in claim 15 wherein said thermistor has a transition temperature in the range of about 200° C. to about 350° C.

17. The article defined in claim 11 further comprising means for thermally insulating at least a portion of said tube.

18. The article defined in claim 17 wherein said means for thermally insulating comprises:

an overwrap concentrically surrounding at least said portion of said tube; and a layer of air disposed between said tube and said overwrap.

19. The article defined in claim 11, further comprising electrical contacts for connecting said thermistor to an external power source.

20. The article defined in claim 11 further comprising means for indicating that said flavor-generating medium has reached the end of its useful life.

21. The article defined in claim 11 further comprising a fusible link which melts to electrically disconnect said thermistor after a predetermined period of operation.

22. The article defined in claim 11, further comprising means for storing electrical energy, disposed within said smoking article and in electrical contact with said thermistor, for delivering electrical energy to said thermistor.

23. The article defined in claim 11 further comprising means for retaining said thermistor and said flavor-generating medium in said tube while allowing air to pass through said tube in contact with said flavor-generating medium.

24. Apparatus for deriving flavor from a flavor-generating medium comprising:

a first heating element in thermal contact with said flavor-generating medium for heating said flavor-generating medium;

a second heating element in thermal contact with said flavor-generating medium for heating said flavor-generating medium; and means for applying electrical energy to said first and second heating elements and thereby heating said flavor-generating medium and causing said flavor-generating medium to release flavor components.

25. The apparatus of claim 24 further comprising means for regulating the amount of electrical energy applied to said first and second heating elements.

26. The apparatus of claim 24 wherein said first heating element raises the temperature of said flavor-generating medium to a first predetermined temperature, and second heating element raises the temperature of said flavor-generating medium to a second predetermined temperature.

27. The apparatus of claim 26 wherein said first predetermined temperature is above ambient temperature and below the temperature at which said flavor-generating medium generates flavor components.

28. The apparatus of claim 26 wherein said second predetermined temperature is above the temperature at which said flavor-generating medium generates flavor components and below the combustion temperature of said flavor-generating medium.

29. The apparatus of claim 26 wherein said electrical energy is applied to said first heating element substantially continuously, and said electrical energy is selectively applied to said second heating element.

30. The apparatus of claim 24 further comprising means disposed within said article for storing said electrical energy before said energy is applied to said first and second heating elements.

31. The apparatus of claim 30 wherein said means for storing electrical energy comprises a battery.

32. The apparatus of claim 30 wherein said means for storing electrical energy comprises a capacitor.

33. The apparatus of claim 24 further comprising means for filtering air and released flavor components.

34. The apparatus of claim 24 wherein said flavor-generating medium comprises a tobacco flavor source.

35. Apparatus for deriving flavor from a flavor-generating medium comprising:

a heating element in thermal contact with said flavor-generating medium; and means for applying electrical energy to said heating element and thereby heating said flavor-generating medium and causing said flavor-generating medium to release flavor components;

means for regulating the amount of electrical energy delivered to said heating element while said electrical energy is being applied to said heating element, said means for regulating comprising means for controlling the temperature of said flavor-generating medium, including means for applying a predetermined temperature controlling cycle to said flavor-generating medium.

36. The apparatus of claim 35 further comprising means disposed within said apparatus for storing said electrical energy before said energy is applied to said heating element.

37. The apparatus defined in claim 36 further comprising a hollow tube; wherein;

said tube provides a housing for said apparatus;

said tube is separable along its length into a first and a second portion; and said first and second portions include said flavor-generating medium and said means for storing electrical energy, respectively.

38. The apparatus defined in claim 37 wherein said first portion of said tube is openable to permit said flavor-generating medium to be replaced.

39. The apparatus of claim 36 further comprising a capacitor disposed within said apparatus, wherein said means for storing simultaneously charges said capacitor and delivers electrical energy to said heating element to raise the temperature of said heating element to a first predetermined temperature.

40. The apparatus of claim 39 wherein said means for storing comprises a battery.

41. The apparatus of claim 39 wherein said capacitor is selectively discharged to deliver electrical energy to said heating element to raise the temperature of said heating element to a second predetermined temperature.

42. The apparatus of claim 41 further comprising means responsive to air passing over the flavor-generating medium for discharging said capacitor.

43. The apparatus of claim 35 wherein said means for storing electrical energy comprises a battery.

44. The apparatus defined in claim 43 wherein said battery is capable of supplying between about 20 and about 500 milliwatt-hours of energy.

45. The apparatus of claim 35 wherein said means for storing electrical energy comprises a capacitor.

46. The apparatus of claim 36 wherein said means for storing is capable of slowly charging with said electrical energy and then quickly discharging said energy to said heating element.

47. The apparatus of claim 46 wherein said means for storing includes a battery which slowly charges a capacitor, and said capacitor quickly discharges to said heating element.

48. The apparatus of claim 35 wherein said heating element raises the temperature of said flavor-generating medium to a temperature of about 100° C. to about 500° C.

49. The apparatus of claim 48 wherein said heating element raises the temperature of said flavor-generating medium to a temperature of about 120° C. to about 400° C.

50. The apparatus of claim 49 wherein said heating element raises the temperature of said flavor-generating medium to a temperature of about 200° C. to about 350° C.

51. The apparatus of claim 35 further comprising means for filtering air and released flavor components.

52. The apparatus of claim 35 wherein said flavor-generating medium comprises a tobacco flavor source.

53. The apparatus of claim 34 wherein said means for applying a predetermined temperature controlling cycle comprises:

means for maintaining said flavor-generating medium at a first predetermined temperature during a first predetermined time interval; and means for maintaining said flavor-generating medium at a second predetermined temperature for at least a second predetermined time interval.

54. The apparatus of claim 53 wherein said means for maintaining a first predetermined temperature comprises means for maintaining a temperature above the temperature at which flavor components are generated and below the combustion temperature of said flavor-generating medium.

55. The apparatus of claim 53 wherein said means for maintaining a second predetermined temperature comprises means for maintaining a temperature above ambient temperature and below the temperature at which said flavor-generating medium generates flavor components.

56. The apparatus of claim 35 further comprising means responsive to air passing over the flavor-generating medium for initiating the application of electrical energy to said heating element.

57. Apparatus for deriving flavor from a flavor-generating medium comprising:

a heating element in thermal contact with said flavor-generating medium for heating said flavor-generating medium to release flavor components; and means for storing electrical energy and applying said energy to said heating element such that more energy is applied to said heating element when said heating element has a relatively low temperature, and less energy is applied to said heating element when said heating element has a relatively high temperature, thereby heating said flavor-generating medium and maintaining said flavor-generating medium at a relatively consistent temperature to release flavor components substantially consistently.

58. The apparatus of claim 57 wherein said heating element raises the temperature of said flavor-generating medium to a temperature of about 100° C. to about 500° C.

59. The apparatus of claim 58 wherein said heating element raises the temperature of said flavor-generating medium to a temperature of about 125° C. to about 400° C.

60. The apparatus of claim 59 wherein said heating element raises the temperature of said flavor-generating medium to a temperature of about 200° C. to about 350° C.

61. The apparatus of claim 57 wherein said flavor-generating medium comprises is a tobacco flavor source.

62. The apparatus of claim 57 further comprising means for filtering air and released flavor components.

63. The apparatus of claim 57 wherein said means for storing electrical energy comprises a battery.

64. The apparatus of claim 63 wherein said battery is rechargeable.

65. The apparatus defined in claim 63 wherein said battery is capable of supplying between about 20 to about 500 milliwatt-hours of energy.

66. The apparatus of claim 57 wherein said means for storing electrical energy comprises a capacitor.

67. The apparatus defined in claim 57 further comprising a hollow tube; wherein:

said tube provides a housing for said apparatus;

said tube is separable along its length into a first and a second portion; and said first and second portions include said flavor-generating medium and said means for storing electrical energy, respectively.

68. The apparatus defined in claim 67 wherein said first portion of said tube is openable to permit said flavor-generating medium to be replaced.

69. Apparatus for supplying electrical energy to electrical contacts of an electrically-powered flavor-generating article having an internal means for storing electrical energy, comprising:

means for storing electrical energy;

means for containing said means for storing electrical energy; and means for making electrical contact between said means for storing and electrical energy and said electrical contacts of said article, to charge said internal means for storing energy of said flavor-generating article.

70. The apparatus defined in claim 69 further comprising means for controlling the amount of electrical energy delivered to said article.

71. The apparatus defined in claim 70 wherein said means for controlling prevents overcharging of a battery within said article by converting excess electrical energy to heat when said battery has been charged to a predetermined level.

72. The apparatus defined in claim 70 wherein said means for controlling prevents overcharging of a battery within said article by opening the electrical circuit between said means for storing electrical energy and said battery when said battery has been charged to a predetermined level.

73. The apparatus defined in claim 69 further comprising means for selectively applying power to said article.

74. The apparatus defined in claim 69 wherein said means for storing electrical energy receives power from a nominal 120 volt power source via a transformer.

75. An electrically-heated flavor-generating article for deriving flavor from a flavor-generating medium comprising:

a heating element in thermal contact with said flavor-generating medium for heating said flavor-generating medium to release flavor components;

a battery for delivering electrical energy to said heating element; and control means comprising an electronic circuit electrically connected to said battery and said heating element for controlling the temperature of said heating element, including means for applying a predetermined voltage cycle to said heating element, said electronic circuit comprising:

switching means for initiating said predetermined voltage cycle, meansf or applying a relatively high voltage to said heating element during a first predetermined time interval, and means for preventing said means for applying a relatively high voltage from operating during a second predetermined time interval.

76. The article of claim 75 further comprising means for filtering air and released flavor components.

77. The article of claim 75 wherein application of said relatively high voltage to said heating element heats said flavor-generating medium to a temperature in the range between the temperature at which flavor components are produced and the combustion temperature of said flavor-generating medium.

78. The article of claim 75 wherein said first predetermined time interval is between about 0.2 seconds to about 4.0 seconds.

79. The article of claim 75 wherein said second predetermined time interval is between about seconds to about 30 seconds.

80. The article of claim 75 wherein said electronic circuit further comprises means for applying a relatively low voltage to said heating element whenever said means for applying a relatively high voltage is not operating.

81. The article of claim 80 wherein application of said relatively low voltage heats said flavor-generating medium to a temperature above ambient temperature but below the temperature at which said flavor-generating medium generates flavor components.

82. The article of claim 81 further comprising means for indicating that said relatively low voltage is being applied to said heating element.

83. The article of claim 75 wherein said flavor-generating means is a tobacco flavor source.

84. The article of claim 74 further comprising means for indicating that said relatively high voltage is being applied to said heating element.

85. The apparatus of claim 70 wherein said switching means is responsive to air passing over the flavor-generating medium.

86. In combination:

(1) A smoking article comprising:

(a) a hollow tube, (b) a flavor-generating medium which releases tobacco flavor components when heated to a predetermined temperature, and (c) means for capturing said flavor-generating medium while allowing air to pass in contact therewith, said means for capturing being thermally conductive and connected to said tube such that at least a portion thereof is exposed; and (2) Apparatus for heating said flavor-generating medium of said smoking article comprising:

(a) a housing having a recess for receiving said portion of said smoking article which captures said flavor-generating medium, (b) a heating element disposed adjacent said recess such that said heating element is in thermal contact with said flavor-generating medium when said portion is received in said recess, and (c) means for selectively applying electrical power to said heating element to raise the temperature of said heating element and thereby heat said flavor-generating medium and cause said flavor-generating medium to release tobacco flavor components.

87. The apparatus of claim 86 wherein said apparatus for heating said flavor-generating medium further comprises means for passing air over the heated flavor-generating medium to mix said air with released tobacco flavor components and to convey the released tobacco flavor components away from said flavor-generating medium with said air.

88. The apparatus of claim 86 wherein said heating element is a positive temperature coefficient thermistor.

89. The apparatus of claim 88 wherein said thermistor is a hollow, open-ended cylinder surrounding at least a portion of said recess.

90. The apparatus of claim 86 wherein said apparatus for heating said flavor-generating medium further comprises means for pre-heating air to be passed over the heated flavor-generating medium.

91. The apparatus of claim 86 wherein said means for selectively applying electrical power is a pressure-activated switch which applies electrical power to said heating element when said smoking article has been properly positioned inside said recess.

92. The method of deriving flavor from a flavor-generating medium comprising the steps of:

positioning a positive temperature coefficient thermistor adjacent said flavor-generating medium; and applying electrical current to said thermistor to raise the temperature of said thermistor and thereby heat said flavor-generating medium and cause said flavor-generating medium to release flavor components.

93. The method defined in claim 92 further comprising the step of passing air over the heated flavor-generating medium to mix said air with released flavor components and to convey the released flavor components away from said flavor-generating medium with said air.

94. The method defined in claim 93 further comprising the steps of:

positioning a heating element in the path of the air to be passed over said flavor-generating medium; and applying electrical current to said heating element to raise the temperature of said heating element and thereby pre-heat air to be passed over said flavor-generating medium.

95. The method defined in claim 93 further comprising the step of filtering the mixture of air and released flavor components.

96. The method defined in claim 92 wherein said electrical current raises the temperature of said thermistor to its transition temperature.

97. The method defined in claim 96 wherein the transition temperature of said thermistor is in the range from about 100° C. to about 500° C.

98. A method for deriving flavor from a flavor-generating medium comprising the steps of:

positioning a heating element adjacent said flavor-generating medium; and applying electrical current to said heating element to raise the temperature of said heating element according to a predetermined temperature cycle and thereby controlling the temperature of said flavor-generating medium and the amount of flavor components released therefrom, said step of applying electrical current comprising regulating the amount of electrical current delivered to said heating element while said electrical current is being applied to said heating element, said regulating step comprising controlling the temperature of said flavor-generating medium by applying a predetermined temperature controlling current cycle to said flavor-generating medium.

99. The method defined in claim 98 wherein said flavor-generating medium comprises a tobacco flavor source.

100. The method defined in claim 98 further comprising the step of passing air over the heated flavor-generating medium to mix said air with the released flavor and to convey the released flavor components away from said flavor-generating medium with said air.

101. The method of claim 100 further comprising the step of filtering said mixture of air and released flavor components.

102. The method of claim 100 further comprising the steps of:

positioning a second heating element in thermal contact with said air; and applying electrical energy to said second heating element for pre-heating said air before passing said air over the heated flavor-generating medium.

103. The method of claim 98 wherein said step of applying a predetermined temperature controlling current cycle comprises the steps of:

applying electrical current to said heating element to raise the temperature of said heating element during a first time interval to a first predetermined temperature that is below the temperature required to release flavor components from said flavor-generating medium; and applying electrical current to raise the temperature of said heating element to a second predetermined temperature during a second predetermined time interval to release flavor components.

104. The method of claim 103 wherein said first predetermined temperature is a temperature above ambient temperature and below the temperature required to release flavor components from said flavor-generating medium.

105. The method of claim 103 wherein said second predetermined temperature is a temperature above the temperature required to release flavor components and below the combustion temperature of said flavor-generating medium.

106. A method for deriving flavor components from a flavor-generating medium, comprising:

positioning a heating element in thermal contact with said flavor-generating medium; and applying electrical energy to said heating element according to a predetermined voltage cycle to raise the temperature of said heating element and thereby heat said flavor-generating medium and cause said flavor-generating medium to release flavor components, said step of applying electrical energy comprising the steps of:

applying a first predetermined voltage to said heating element for a first time interval to heat said flavor-generating medium to a temperature above ambient temperature but below the temperature at which said flavor-generating medium produces flavor components; and applying a second predetermined voltage to said heating element for a second predetermined time interval to heat said flavor-generating medium to a temperature above the temperature at which said flavor-generating medium produces flavor components but below the combustion temperature.

107. The method defined in claim 106 further comprising the step of passing air over the heated flavor-generating medium to mix said air with the released flavor components and to convey the released flavor components away from said flavor-generating medium with said air.

108. The method defined in claim 107 further comprising the step of filtering said mixture of air and released flavor components.

109. The method of claim 106 wherein said step of applying electrical energy comprises the steps of:

charging an energy storage device with electrical energy at a first predetermined rate; and discharging said energy from said energy storage device to said heating element at a second predetermined rate to heat said heating element.

110. Apparatus for deriving flavor from a flavor-generating medium comprising:

a heating element in thermal contact with said flavor-generating medium for heating said medium to release flavor components;

means for sensing the temperature of said flavor-generating medium; and means responsive to said means for sensing for controlling power to said heating element and thereby controlling the heating of said flavor-generating medium.

111. The apparatus of claim 110 wherein said means for sensing is a thermocouple.

112. The apparatus of claim 110 wherein said means for sensing is a thermistor.

113. Apparatus for deriving flavor from a flavor-generating medium comprising:

a heating element, said heating element having an external surface in thermal contact with an external surface of said flavor-generating medium; and means for applying electrical energy to said heating element and thereby heating said flavor-generating medium and causing said flavor-generating medium to release flavor components; and means for regulating the amount of electrical energy delivered to said heating element while said electrical energy is being applied to said heating element.

114. The apparatus of claim 113 wherein said flavor-generating medium comprises a packed bed of pellets containing flavor components.

115. The apparatus of claim 113 wherein said flavor-generating medium comprises an extruded rod containing flavor components.

116. The apparatus of claim 113 wherein said flavor-generating medium surrounds an external surface of said heating element.

117. The apparatus of claim 113 wherein said heating element surrounds an external surface of said flavor-generating medium.

118. The apparatus of claim 113 further comprising means disposed within said apparatus for storing said electrical energy before said energy is applied to said heating element.

119. The apparatus defined in claim 118 further comprising a hollow tube; wherein:

said tube provides a housing for said apparatus;

said tube is separable along its length into a first and a second portion; and said first and second portions include said flavor-generating medium and said means for storing electrical energy, respectively.

120. The apparatus defined in claim 119 wherein said first portion of said tube is openable to permit said flavor-generating medium to be replaced.

121. The apparatus of claim 118 wherein said means for storing electrical energy comprises a battery.

122. The apparatus defined in claim 121 wherein said battery is capable of supplying between about 20 and about 500 milliwatt-hours of energy.

123. The apparatus of claim 118 wherein said means for storing electrical energy comprises a capacitor.

124. The apparatus of claim 118 wherein said means for storing is capable of slowly charging with said electrical energy and then quickly discharging said energy to said heating element.

125. The apparatus of claim 124 wherein said means for storing includes a battery which slowly charges a capacitor, and said capacitor quickly discharges to said heating element.

126. The apparatus of claim 113 wherein said heating element raises the temperature of said flavor-generating medium to a temperature of about 100° C. to about 500° C.

127. The apparatus of claim 126 wherein said heating element raises the temperature of said flavor-generating medium to a temperature of about 120° C. to about 400° C.

128. The apparatus of claim 127 wherein said heating element raises the temperature of said flavor-generating medium to a temperature of about 200° C. to about 350° C.

129. The apparatus of claim 113 further comprising means for filtering air and released flavor components.

130. The apparatus of claim 113 wherein said flavor-generating medium comprises a tobacco flavor source.

131. The apparatus of claim 113 wherein said means for regulating comprises means for controlling the temperature of said flavor-generating medium, including means for applying a predetermined temperature controlling cycle to said flavor-generating medium.

132. The apparatus of claim 131 wherein said means for applying a predetermined temperature controlling cycle comprises:

means for maintaining said flavor-generating medium at a first predetermined temperature during a first predetermined time interval; and means for maintaining said flavor-generating medium at a second predetermined temperature for at least a second predetermined time interval.

133. The apparatus of claim 132 wherein said means for maintaining a first predetermined temperature comprises means for maintaining a temperature above the temperature at which flavor components are generated and below the combustion temperature of said flavor-generating medium.

134. The apparatus of claim 132 wherein said means for maintaining a second predetermined temperature comprises means for maintaining a temperature above ambient temperature and below the temperature at which said flavor-generating medium generates flavor components.

135. A method for deriving flavor from a flavor-generating medium comprising the steps of:

positioning an external surface of a heating element adjacent an external surface of said flavor-generating medium; and applying electrical current to said heating element to raise the temperature of said heating element according to a predetermined temperature cycle and thereby controlling the temperature of said flavor-generating medium and the amount of flavor components released therefrom.

136. The method of claim 135 wherein said flavor-generating medium comprises a packed bed of pellets containing flavor components.

137. The method of claim 135 wherein said flavor-generating medium comprises an extruded rod containing flavor components.

138. The method of claim 135 wherein said flavor-generating medium is positioned around an external surface of said heating element.

139. The method of claim 135 wherein said heating element is positioned around an external surface of said flavor-generating medium.

140. The method defined in claim 135 wherein said flavor-generating medium comprises a tobacco flavor source.

141. The method defined in claim 135 further comprising the step of passing air over the heated flavor-generating medium to mix said air with the released flavor and to convey the released flavor components away from said flavor-generating medium with said air.

142. The method of claim 141 further comprising the step of filtering said mixture of air and released flavor components.

143. The method of claim 141 further comprising the steps of:

positioning a second heating element in thermal contact with said air; and applying electrical energy to said second heating element for pre-heating said air before passing said air over the heated flavor-generating medium.

144. The method of claim 135 wherein said step of applying electrical current comprises the steps of:

applying electrical current to said heating element to raise the temperature of said heating element during a first time interval to a first predetermined temperature that is below the temperature required to release flavor components from said flavor-generating medium; and applying electrical current to raise the temperature of said heating element to a second predetermined temperature during a second predetermined time interval to release flavor components.

145. The method of claim 144 wherein said first predetermined temperature is a temperature above ambient temperature and below the temperature required to release flavor components from said flavor-generating medium.

146. The method of claim 144 wherein said second predetermined temperature is a temperature above the temperature required to release flavor components and below the combustion temperature of said flavor-generating medium.

* * * * *